US006341717B2

(12) United States Patent
Auer

(10) Patent No.: US 6,341,717 B2
(45) Date of Patent: Jan. 29, 2002

(54) METERING PUMP DISPENSER WITH AT LEAST TWO METERING PUMPS

(75) Inventor: Günter Auer, Villingen-Schwenningen (DE)

(73) Assignee: Megaplast GmbH & Co. KG (DE)

( * ) Notice: Subject to any disclaimer, the term of this patent is extended or adjusted under 35 U.S.C. 154(b) by 0 days.

(21) Appl. No.: 09/820,117

(22) Filed: Mar. 28, 2001

(30) Foreign Application Priority Data

Apr. 1, 2000 (DE) ..... 200 06 099

(51) Int. Cl.[7] ..... B05B 7/04
(52) U.S. Cl. ..... 222/135; 222/145.1
(58) Field of Search ..... 222/135, 137, 222/144.5, 145.1, 153, 183

(56) References Cited

U.S. PATENT DOCUMENTS

| | | | | |
|---|---|---|---|---|
| 4,773,562 A | | 9/1988 | Gueret | |
| 4,792,062 A | * | 12/1988 | Goncalves | 222/135 |
| 4,826,048 A | * | 5/1989 | Skorka et al. | 222/137 |
| 4,949,874 A | | 8/1990 | Fiedler et al. | |
| 5,169,029 A | * | 12/1992 | Behar et al. | 222/135 |
| 5,224,627 A | * | 7/1993 | Weag | 222/135 |
| 5,411,176 A | * | 5/1995 | Favre | 222/137 |
| 5,901,883 A | * | 5/1999 | Ritsche | 222/137 |
| 6,082,588 A | * | 7/2000 | Markey et al. | 222/137 |
| 6,216,915 B1 | * | 4/2001 | Harman et al. | 222/137 |

FOREIGN PATENT DOCUMENTS

DE 41 20 644 C1 3/1993

* cited by examiner

*Primary Examiner*—Philippe Derakshani
*Assistant Examiner*—Thach H. Bui
(74) *Attorney, Agent, or Firm*—McGlew and Tuttle, P.C.

(57) ABSTRACT

A metering pump dispenser for simultaneous metered dispensing of liquid and/or pasty media has at least two separate storage chambers (1, 2), which are arranged in a common pump housing (9) and with which separate metering pumps with a priming valve and a dispensing valve each are associated. The metering pumps can be actuated by a common actuating member, which is mounted axially movably in the head part of the pump container and has one or more dispensing channels. To make it possible to manufacture the metering pump dispenser in a simple manner and to operate it easily, a pivoted lever (40), which is pivotable around a pivot axis extending at right angles to the housing axis, acts axially on the actuating member (7) with a short lever arm at least approximately in the central plane (32) located between the metering pumps and can be actuated manually by means of a longer lever arm, is mounted in a head part section (30) of the pump housing (9), which the head part section is extended beyond the actuating member (7).

12 Claims, 4 Drawing Sheets

METERING PUMP DISPENSER WITH AT LEAST TWO METERING PUMPS

FIELD OF THE INVENTION

The present invention pertains to a metering pump dispenser for the simultaneous, metered dispensing of liquid and/or pasty media from at least two separate storage chambers, which are arranged in a common pump housing and with which separate metering pumps with a priming valve and a dispensing valve each are associated, wherein the metering pumps can be actuated by means of a common actuating member, which is mounted axially movably in the head part of the pump container and has one or more dispensing channels.

BACKGROUND OF THE INVENTION

In prior-art metering pump dispensers (U.S. Pat. No. 4,773,562) with separate containers for different media, which containers are arranged next to one another with parallel axes, or with coaxially arranged containers for different media (U.S. Pat. No. 4,949,874), in which a separate metering pump is associated with each container, the metering pumps are actuated jointly by an actuating member, which is or can be attached at the top and performs axial movements, during which restoring spring forces are overcome. The actuating members are guided axially, so that the resisting force which counteracts the actuation of the actuating member by the restoring forces and the viscosity of the media to be dispensed, must be applied at a ratio of 1:1.

The actuating forces to be applied may be considerable especially in the case of pasty media which are dispensed in predetermined amounts upon each stroke of the actuating member. It may happen that the actuating member cannot be actuated by one hand, which may not only make it difficult to use such metering pump dispensers with at least two metering pumps and two storage containers but also questionable on the whole.

A metering pump dispenser for the simultaneous, metered dispensing of liquid and/or pasty media from at least two separate storage chambers has also been known (DE 41 20 644 C1), in which the actuating member is mounted in a lever-like manner pivotably in one direction around a pivot bearing in a head part of the pump housing, which said head part axially projects over the storage chamber, to perform limited pump strokes. The metering pumps each have bellows as a pumping member, which is connected to a pump housing on the housing side and to the common actuating member on the dispensing side.

Each metering pump is provided here with a priming valve and a dispensing valve, via which the storage chambers are in connection with one or more dispensing channels. The dispensing channels are arranged in this metering pump dispenser directly in the actuating member such that they end in a common plane of a dispensing nozzle. The pivot axis of the pivot bearing is arranged at right angles to a common symmetry plane of the metering pumps such that the metering pumps are located at different distances from the pivot axis and have different effective lever arms relative to the pivot axis and perform different pump strokes, which are at a fixed, preselectable ratio to one another, simultaneously and in the same direction during the actuation of the actuating member.

While the two metering pumps are actuated uniformly during each pump stroke in the case of the metering dispenser of this class, the pump strokes of the two metering pumps are fundamentally different in this prior-art metering pump dispenser because the actuating member is designed and mounted as a one-armed lever.

SUMMARY AND OBJECTS OF THE INVENTION

The primary object of the present invention is to provide a metering dispenser of the type mentioned in the introduction, whose actuating member can be actuated manually by applying a weaker force.

This object is accomplished according to the present invention by a pivoted lever, which is pivotable around a pivot axis extending at right angles to the housing axis, acts axially with a short lever arm on the actuating member at least approximately in the central plane located between the metering pumps and can be actuated manually by means of a longer lever arm, being mounted in a head part section of the pump housing, which said head part section is extended beyond the actuating member.

By using an additional pivoted lever, via which the axially movable actuating member, which uniformly actuates both metering pumps, is moved, the force to be applied for the actuation is considerably reduced as a consequence of the different lever arms that now become effective. This reduction makes it possible to perform the actuation of the actuating member by means of the pivoted lever relatively easily with one finger of the hand, which holds the pump housing and the entire metering dispenser during its use.

Due to the arrangement provided, it is readily possible to obtain a lever arm ratio of 2:1, which means that the force that must be applied to actuate the actuating member via the pivoted lever is half the force acting directly on the actuating member.

Thus, the user of such a metering dispenser has the feeling that he is actuating only one metering pump.

This favorable lever arm ratio is facilitated by the elliptical cross-sectional shape of the pump housing and the arrangement of the pivoted lever in the longitudinal axis of the elliptical shape.

A possible design feature with the separate housing part adapted to the cross-sectional shape of the said pump housing, which separate housing part can be lockingly attached to the upper end section of the said pump housing and has an opening for movably accommodating the said dispensing channel or dispensing channels of the actuating member, may be provided to make it possible to manufacture and especially mount the head part section in a simple manner.

The possible embodiment of the present invention, in which the housing part has two mounting supports with coaxial sockets in one half of the housing under a closed front wall section in a symmetrical arrangement in relation to an axial central plane of the housing and a said button opening, which is located in the plane of the front wall section and is extended in a recess of the axial wall is provided in the other half of the housing, leads not only to a favorable arrangement and mounting of the pivoted lever, but also to the advantage that the opening necessary for the actuation of the pivoted lever in the housing part can be closed in the inoperative position of the pivoted lever. The provision of a transverse wall and an additional side wall also serve this purpose.

The possible embodiments in which the housing part has two guide walls, which are arranged symmetrically to the axial central plane of the housing and extend in parallel to the plane, as a lateral limitation of the front-side button opening and for laterally guiding the said pivoted lever and an arched wall apron extends at least over the range of movement of a said button surface of the pivoted lever, guarantee that the opening of the housing part forming the head part section, in which the pivoted lever is accommodated, also remains largely closed during the actuation of the pivoted lever. This is also important because as a result, the actuating finger or fingers of the user cannot come into contact with any edges of the housing, which could cause jamming or even cutting, during the actuation of the pivoted lever.

A functionally favorable, low-friction transmission of forces between the pivoted lever and the actuating member, on the front surface of which the pivoted lever acts via the cam-like, arc-shaped projections provided may also be provided.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
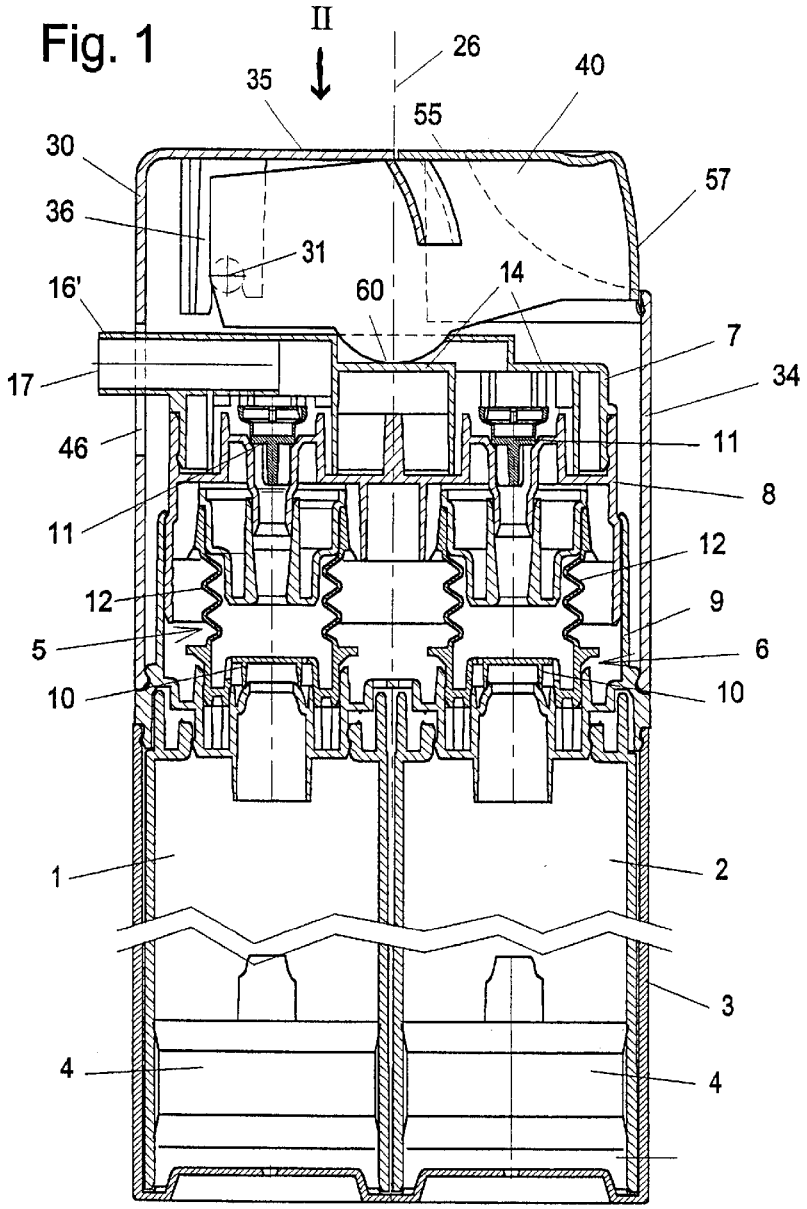
FIG. 1 is a somewhat simplified sectional view of a metering dispenser with two separate storage chambers and two metering pumps.
Figure 2:
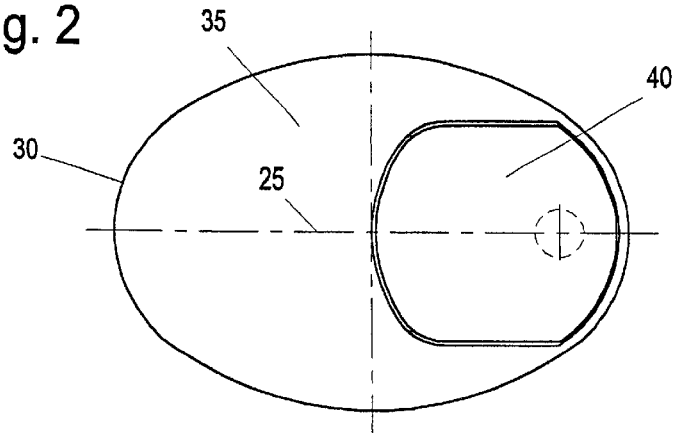
FIG. 2 is a front view in the direction II from FIG. 1.

Referring to the drawings in particular, the metering pump dispenser shown as a whole in FIG. 1 for the simultaneous, metered dispensing of liquid, but especially pasty media has two separate storage chambers 1 and 2, which are arranged in parallel next to one another in a common housing lower part 3 and are provided with a follower piston 4 each.

A separate metering pump 5 and 6, respectively, is associated with each of these storage chambers 1 and 2, attached at the top. These two metering pumps 5 and 6 are provided with a common actuating member 7, which is shown as a one-piece plastic part in FIGS. 5 through 9.

This actuating member 7 is inserted on the top side into a pumping stroke housing 8 by means of locking connections in a positive-locking manner, and it is guided axially movably together with the said pumping stroke housing in a pump housing 9. The two metering pumps have a priming valve 10 as well as a dispensing valve 11 each and also a bellows 12 each as a pumping member, the said bellows 12 being connected to the pump housing 9 on the priming side and to the common actuating member 7 on the dispensing side.

Figure 3:
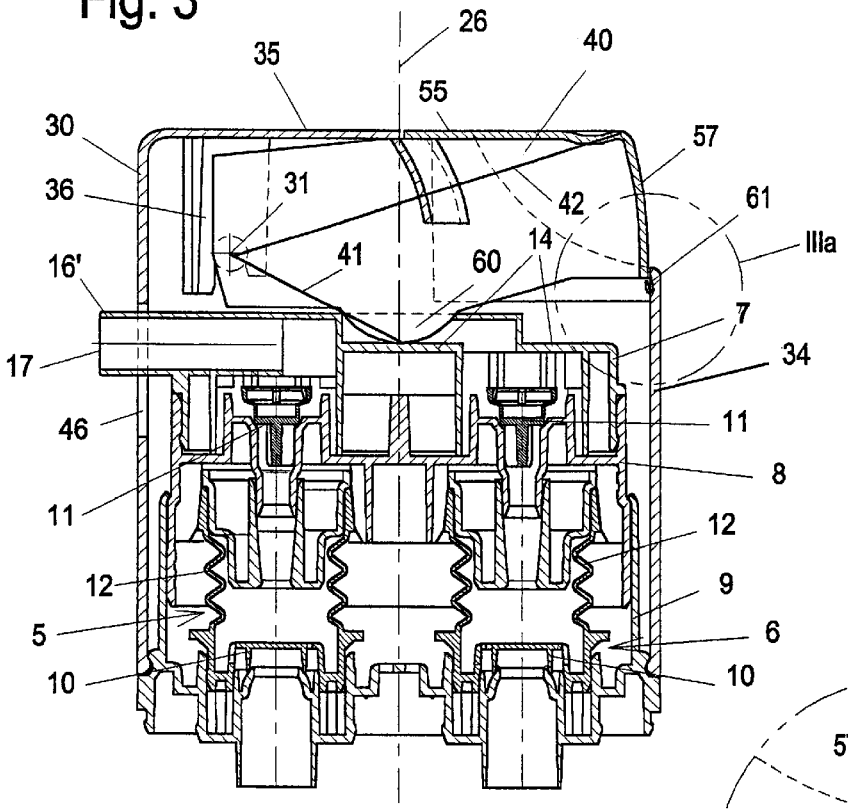
FIG. 3 is a sectional view of the head part of the metering dispenser shown in FIG. 1 in the inoperative position of the actuating member.
Figure 4:
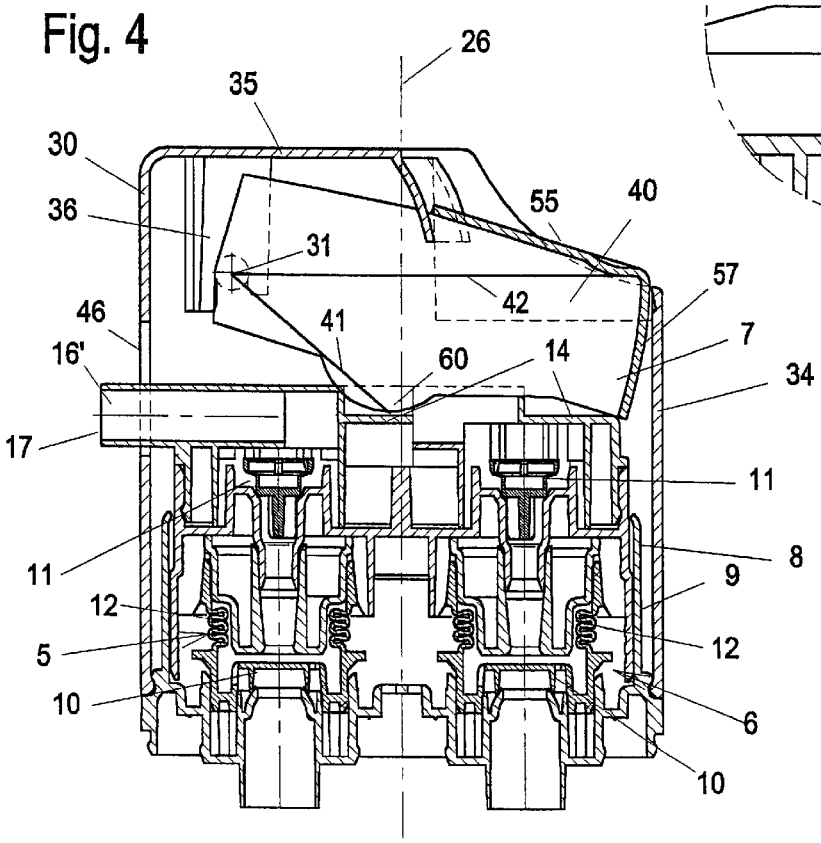
FIG. 4 is a sectional view, as in FIG. 3, of the head part of the metering pump dispenser, in which the pivoted lever assumes the position corresponding to the end of a pump stroke just performed.

The uniformly metered dispensing of the preferably pasty media being stored in the two storage chambers 1 and 2 is achieved by the actuating member 7 performing a pumping stroke together with the pumping stroke housing 8 in the pump housing 9, during which it is axially displaced from the position shown in FIG. 1 and FIG. 3 into the downwardly displaced position shown in FIG. 4. The two bellows 12 are axially shortened during the performance of this pumping stroke, as a result of which their capacity is greatly reduced and the medium located in them is pressed through the dispensing valves 11 into the dispensing channels 15 and 16 of the actuating member 7.

The actuating member 7 shown as an individual part in FIGS. 5 through 9 comprises a ring wall 13, which is adapted to the elliptical cross-sectional shape of the pumping stroke housing 8 and is provided with a closed front wall 14.

In the plane of the front wall 14, the actuating member 7 has two dispensing channels 15 and 16, which are separated by an axially extending partition 18 and end in a common, axially parallel dispensing plane 17 of a tubular section 16'. The dispensing channel 15 is in connection with the metering pump 6. The discharge channel 16 is in connection with the metering pump 5. The connection openings 20 and 21 are inside axially extending cylindrical ring walls 22 and 23, respectively, which, starting from the front wall 14, are directed toward the metering pumps 5 and 6 and in which the dispensing valves 11 are accommodated (see FIGS. 1, 3 and 4).

Figure 6:
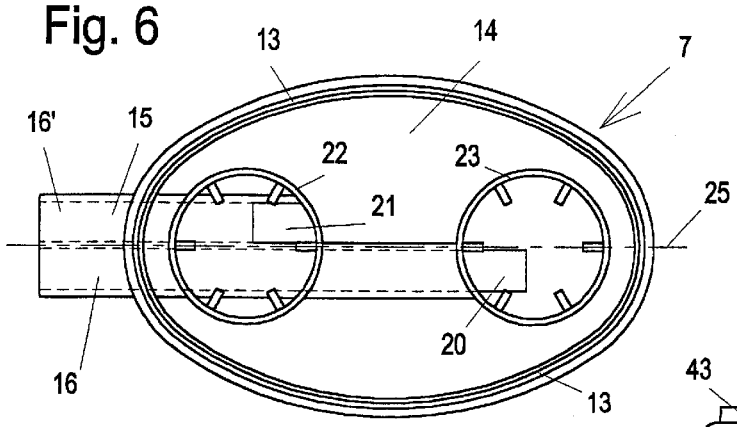
FIG. 6 is a bottom view of the actuating member in direction VI from FIG. 5.
Figure 7:
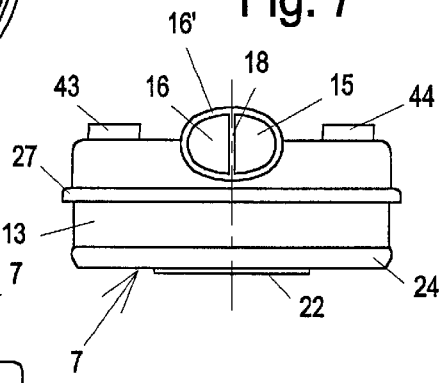
FIG. 7 is the side view of the actuating member in direction VII from FIG. 5.
Figure 5:
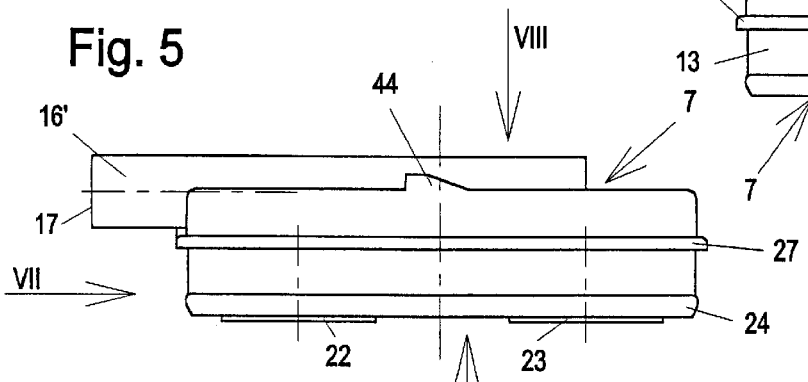
FIG. 5 is a side view of the actuating member as an individual part.
Figure 9:
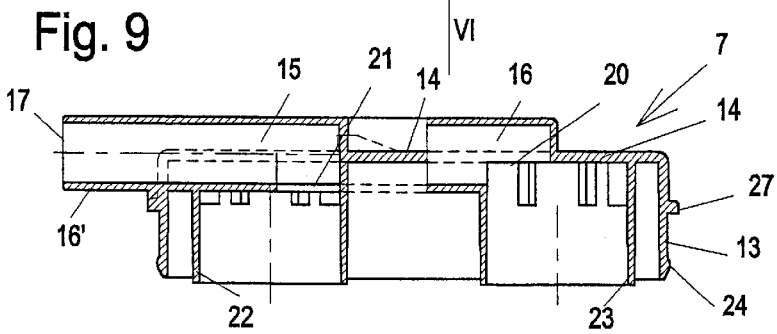
FIG. 9 is a section along the section line IX—IX from FIG. 8.
Figure 8:
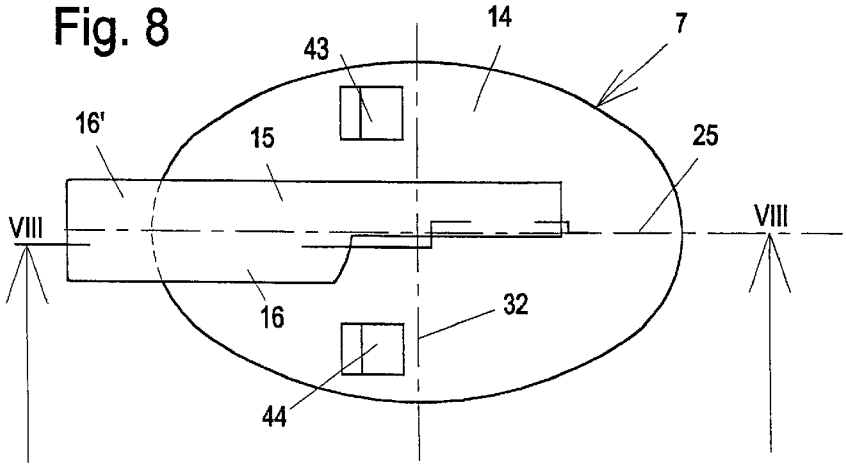
FIG. 8 is a top view of the actuating member in direction VIII from FIG. 5.

As is apparent from FIGS. 6 and 8, the two dispensing channels 15 and 16 extend in parallel to the longitudinal axis 25 of the elliptical cross-sectional shape of the actuating member 7 and thus also at right angles to the housing axis 26 of the pump housing 3.

As is apparent from FIG. 1, the two dispensing channels 15 and 16 end in the axially parallel end plane 17 of the tubular section 16', which is located radially outside the housing circumference.

As was mentioned above, the actuating member 7 is firmly connected to the pumping stroke housing 8 by locking connections 24 engaging one another in a positive-locking manner and an outer ring collar 27.

To actuate the actuating member 7 and to actuate the two metering pumps 5 and 6 by means of the actuating member 7, a pivoted lever 40 is mounted in a head part section 30 of the pump housing 9, which head part section is extended beyond the actuating member 7. This pivoted lever 40 is mounted pivotably around a pivot axis 31 extending at right angles to the housing axis 26 and is also designed such that it axially acts on the actuating member 7 with a short lever arm 41 at least approximately in the central plane 32 located between the two metering pumps 5 and 6, which said central plane coincides with the housing axis 26, and it can be actuated by means of a longer lever arm 42 manually, preferably with a finger of the hand holding the metering pump dispenser.

The head part section 30 is designed as a one-piece, separate housing part 33 adapted to the elliptical cross-sectional shape of the pump housing 3. It is attached lockingly in a positive-locking manner to the lower section of the pump housing 9, which is firmly connected to the housing lower part 3. It consists of a plastic and has an axial wall 34, whose cross-sectional shape is adapted to the elliptical cross-sectional shape of the pump housing 9 and is provided with a closed front wall section 35.

Figure 12:
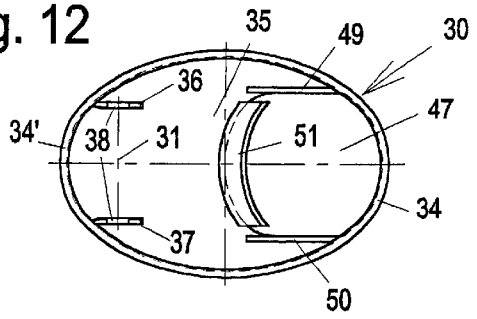
FIG. 12 is the bottom view in direction XII from FIG. 11.
Figure 14:
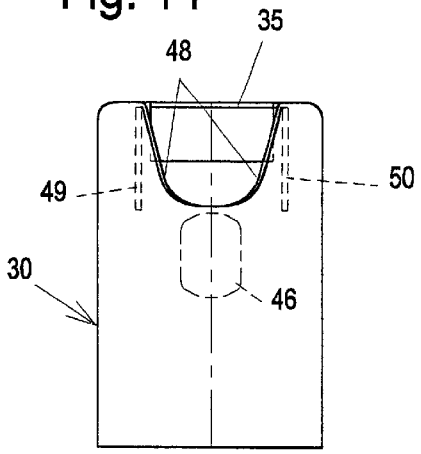
FIG. 14 is the side view in direction XIV from FIG. 11.
Figure 11:
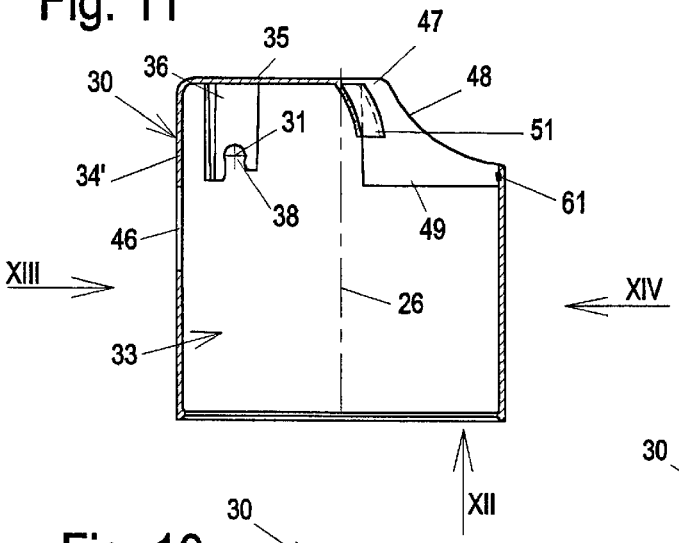
FIG. 11 is a section XI—XI from FIG. 10.
Figure 13:
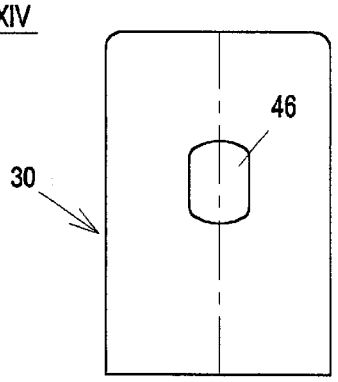
FIG. 13 is the side view in direction XIII from FIG. 11.
Figure 10:
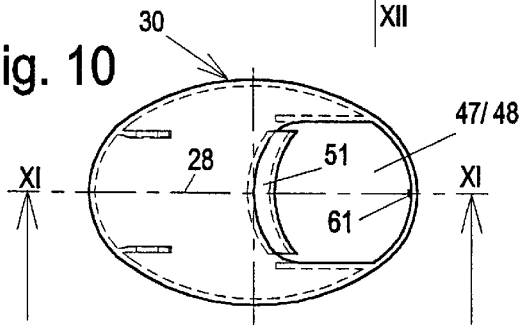
FIG. 10 is a top view of the head part section as an individual part.

Two mounting supports 36 and 37, which are arranged in one piece on the inside of the front wall section 35 and are connected to same in one piece, are arranged in one half of the housing under the closed front wall section 35 in symmetrical arrangement in relation to the axial central plane 28 located in the longitudinal axis 25 of the elliptical cross section. These two mounting supports 36 and 37 protrude, with axes parallel to the housing axis 26, into the interior space of the housing part 33 and are provided with mutually coaxial sockets 38 at their lower ends and, as is apparent from FIGS. 10 and 12, are also connected in one piece to the axial wall 34 on the inside.

The two sockets 38 have a common axis, which is the pivot axis 31 of the pivoted levers 40 and extends horizontally and consequently at right angles to the housing axis 26 in the vertical position of the housing axis 26.

An elongated hole-like opening 46, through which the common tubular section 16' of the two dispensing channels 15 and 16 projects axially movably to the outside axially in parallel to the central plane 28 of the housing, is located in the axial wall section 34' located between the two mounting supports 36 and 37. In the other half of the housing, the housing part 33 is provided with a button opening 47, which is located n the plane of the front wall section 35 and is extended in a rounded opening 48 of the axial wall 34. Two guide walls 49 and 50, which are arranged symmetrically to the axial central plane 28 of the housing and extend in parallel to same, are provided as the lateral limitation of the front-side button opening 47 and at the same time for the lateral guiding of the pivoted lever 40. A likewise arched wall apron 51, which extends in the axial direction at least over the range of movement of the pivoted lever 40 provided with a button surface 55 and otherwise has the shape of an arch section concentrical to the pivot axis 31, is provided between the said guide walls 49 and 50 along the bent edge of the front wall section 35, which edge limits the button opening 47.

Figure 15:
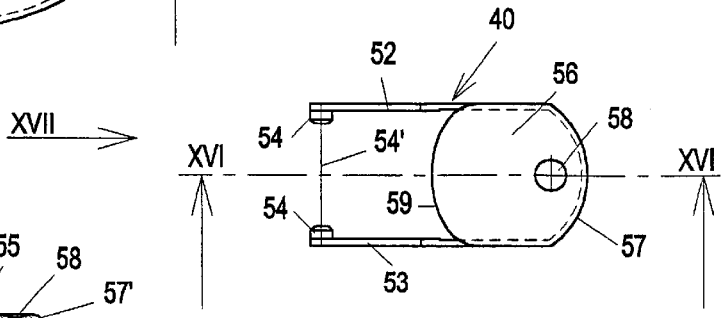
FIG. 15 is the top view of the pivoted lever as an individual part.
Figure 16:
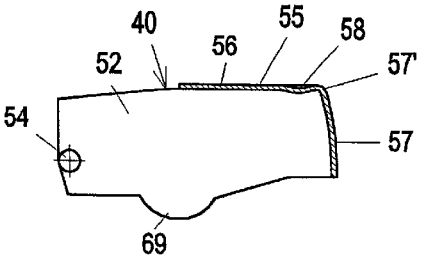
FIG. 16 is a section XVI—XVI from FIG. 15.
Figure 17:
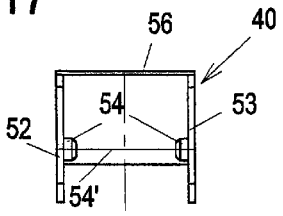
FIG. 17 is a side view XVII from FIG. 15.

The pivoted lever 40 shown as an individual part in FIGS. 15 through 17 consists of a plastic. It has mutually parallel wall elements 52 and 53, which are provided with a mounting pin 54 each on the sides facing one another. The distance between these two wall elements 52 and 53 is adjusted to the distance between the two mounting supports 36/37. The two mounting pins 54 are arranged coaxially to one another and are otherwise designed such that they can be lockingly inserted into the sockets 38 of the mounting supports 36 and 37, which sockets are open on the underside.

In the mounted state, the two wall elements 52 and 53 extend in a symmetrical position in parallel to the housing axis 26, and the common axis 54' of their sockets 54 coincides with the pivot axis 31. The two wall elements 52 and 53 are connected to one another in one piece by a transverse wall 56, whose top side or upper outer side forms the button surface 55. This upper transverse wall 56 is joined, in one piece and by means of a rounded transition edge 57', by a side wall 57, which extends over the axial opening 48 of the housing part 33 and of the head part section 30. A button recess 58 is arranged in the edge area, in which the transverse wall 56 passes over into the side wall 57.

The limiting edge 59 of the transverse wall 56, which limiting edge faces the two sockets 54, is adapted to the arc shape of the wall apron 51 of the housing part 33 such that in the mounted position, the pivoted lever 40 can perform the pivoting movement shown in FIGS. 3 and 4 around the pivot axis 31, but there is only a narrow gap between the wall apron 51 and the transverse wall 56.

FIGS. 3 and 4 show the two functional end positions of the pivoted lever 40, in which both the button opening 47 and the recess 48 are closed by the lateral guide walls 49 and 50 as well as by the transverse wall 56 and the side wall 57 of the pivoted lever 40, so that no foreign bodies, at least no larger foreign bodies can reach the interior of the housing part 33.

The two wall elements 52 and 53 are provided on their undersides with a cam-like, arc-shaped projection 60, by means of which they lie on the top side of the actuating member 7 on both sides of the dispensing channels 15 and 16 of the actuating member 7, the said top side being provided with two wedge-shaped humps 43 and 44 for this purpose.

Figure 3A:
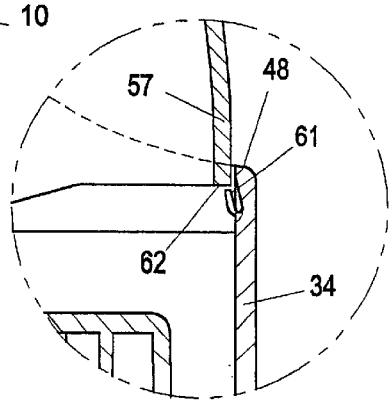
FIG. 3*a* is an enlarged detail sectional view IIIa from FIG. 3.

As an originality protection means, the axial wall 34 of the housing part 33 has, on the inside and at the deepest point of the recess 48, an inwardly projecting break-off tab 61, which is broken off from the lower edge 62 of the side wall 57 of the pivoted lever during the first actuation of the pivoted lever (see FIG. 3*a*). It is recognized from this whether the metering dispenser has already been used or is still new.

While specific embodiments of the invention have been shown and described in detail to illustrate the application of the principles of the invention, it will be understood that the invention may be embodied otherwise without departing from such principles.

What is claimed is:

1. A metering pump dispenser for the simultaneous, metered dispensing of liquid and/or pasty media, the pump dispenser comprising:

a first storage chamber;

a second storage chamber separate from said first storage chamber;

a common pump housing and head part section, said first storage chamber and said second storage chamber being arranged in said common pump housing;

a first metering pump with a priming valve and a dispensing valve connected to said first storage chamber;

a second metering pump with a priming valve and a dispensing valve connected to said second storage chamber, said first metering pump being separate from said second metering pump;

a common actuating member for actuating each of said first metering pump and said second metering pumps, said common actuating member being mounted axially movably in said head part section and having one or more dispensing channels;

a pivot lever pivoting around a pivot axis extending at right angles to a housing axis, said pivot lever acting axially on said actuating member with a short lever arm at least approximately in a central plane located between said metering pumps and being actuatable manually by a longer lever arm mounted in a head part section of said pump housing, said head part section extended beyond said actuating member.

2. A metering pump dispenser in accordance with claim 1, wherein said head part section is separate from said housing part adapted to a cross-sectional shape of said pump housing, said head part section being lockingly attached to an upper end section of said pump housing and having an opening for movably accommodating said dispensing channel of said actuating member.

3. A metering pump dispenser in accordance with claim 2, wherein said head part section has two mounting supports with coaxial sockets in one half of said housing under a closed front wall section in a symmetrical arrangement in relation to an axial central plane of said housing and a said button opening, which is located in the plane of the said front wall section and is extended in a recess of said axial wall, is provided in the other half of the housing.

4. A metering pump dispenser in accordance with claim 1, wherein said housing part has two guide walls, said guide walls being arranged symmetrically to an said axial central plane of the housing and extending in parallel to said plane, as a lateral limitation of the front-side button opening and for laterally guiding said pivoted lever.

5. A metering pump dispenser in accordance with claim 2, wherein said housing part has two guide walls, said guide walls being arranged symmetrically to an said axial central plane of the housing and extending in parallel to said plane, as a lateral limitation of the front-side button opening and for laterally guiding said pivoted lever.

6. A metering pump dispenser in accordance with claim 3, wherein said housing part has two guide walls, said guide walls being arranged symmetrically to an said axial central plane of the housing and extending in parallel to said plane, as a lateral limitation of the front-side button opening and for laterally guiding said pivoted lever.

7. A metering pump dispenser in accordance with claim 4, wherein an arched wall apron extends at least over a range of movement of a button surface of said pivoted lever, said arched wall apron being arranged at a front wall section between said two guide walls.

8. A metering pump dispenser in accordance with claim 1, wherein said pivoted lever comprises two wall elements, said wall elements being parallel to said housing axis and each being provided with a mounting pin, said two wall elements being connected by a transverse wall located in an area of said button opening, said transverse wall having an outside forming a button surface.

9. A metering pump dispenser in accordance with claim 8, wherein said two wall elements are provided with arc-shaped projections located on an upper front surface of said actuating member.

10. A metering pump dispenser in accordance with claim 8, wherein said two wall elements of said pivoted lever are connected to one another by a side wall, said side wall joining said transverse wall and extending over an axial height of said recess of said housing part.

11. A metering pump dispenser in accordance with claim 9, wherein said two wall elements of said pivoted lever are connected to one another by a side wall, said side wall joining said transverse wall and extending over an axial height of said recess of said housing part.

12. A metering pump dispenser in accordance with claim 10, wherein said axial wall of said head part section has, on an inside at a deepest point of said recess, an inwardly projecting break-off tab, said tab protruding into the path of movement of a part of said pivoted lever.

* * * * *